United States Patent [19]

Ichikawa et al.

[11] Patent Number: 4,604,951

[45] Date of Patent: Aug. 12, 1986

[54] INTAGLIO PRINTING MACHINE

[75] Inventors: Ieyasu Ichikawa, Machida; Shigeji Arai, Matsudo, both of Japan

[73] Assignee: Komori Printing Machinery Co., Ltd., Tokyo, Japan

[21] Appl. No.: 763,383

[22] Filed: Aug. 6, 1985

[30] Foreign Application Priority Data

Sep. 3, 1984 [JP] Japan ..... 59-182573

[51] Int. Cl.[4] ..... B41F 9/00; B41F 31/26

[52] U.S. Cl. ..... 101/153; 101/350

[58] Field of Search ..... 101/152, 153, 154, 155–157, 101/170, 349, 350, 363

[56] References Cited

U.S. PATENT DOCUMENTS 2,733,656 2/1956 Gottsching ..... 101/170 X 4,516,496 5/1985 Grori ..... 101/153

FOREIGN PATENT DOCUMENTS 626200 7/1949 United Kingdom .

*Primary Examiner*—J. Reed Fisher

*Attorney, Agent, or Firm*—Townsend & Townsend

[57] ABSTRACT

An intaglio printing machine includes a plate cylinder having a plate thereon, a pattern roller having projections which are in rolling contact with the outer surface of the plate, and an inking unit with a duct roller which is in rolling contact with the pattern roller, wherein the duct roller has substantially the same diameter as that of the pattern roller which includes the projections, and ink holding recesses having different depths corresponding to those of the plate are formed in the outer surface of the duct roller along the circumferential and axial directions thereof.

5 Claims, 7 Drawing Figures

INTAGLIO PRINTING MACHINE

BACKGROUND OF THE INVENTION

The present invention relates to an intaglio printing machine.

A conventional intaglio printing machine comprises a plate cylinder having a copperplate thereon, a pattern roller which is in rolling contact with the outer surface of the copperplate, and an inking unit with a duct roller in rolling contact with the pattern roller. Ink attached by the inking unit to projections of the pattern roller is filled in recesses as an image portion of the copperplate. The ink attached to a nonimage portion is removed, and the ink left in the recesses is transferred to a sheet fed between the plate cylinder and an impression cylinder under a high pressure, thereby performing intaglio printing.

FIG. 1 is a side sectional view of a conventional intaglio printing machine to explain an ink supply principle. FIG. 2 is a plan view of a banknote 1 as an example of printed matter. The ink supply principle will be described in detail with reference to FIGS. 1 and 2. Assume that a three-color image of the banknote 1 has a dark green pattern 1A representing a peripheral pattern, a sepia pattern 1B representing the right profile and central number, and a dark blue pattern 1C representing the lower left mark, which are formed by three separate printing surfaces. A plate cylinder 2 has a diameter which is three times that of a regular plate cylinder, so that three plates 3 are mounted thereon. Each plate 3 has 18 recesses 3*a* which constitute a matrix of 6 rows×3 columns. The recesses 3*a* represent the pattern of the banknote 1. The recesses comprise shallow and deep recesses in accordance with the pattern of the banknote. In particular, when a banknote is printed, depths of the recesses 3*a* fall within the range between 40μ and 180μ. Three sets of an inking unit 4 and a pattern roller 5 are prepared in accordance with the pattern colors. Only the structure for one pattern color in the intaglio printing machine in FIG. 1 is illustrated. The pattern roller 5 has a diameter about ⅓ that of the plate cylinder 2. The pattern roller 5 has six projections 5*a* each corresponding to one row of the banknote 1. These projections 5*a* are larger than the recesses 3*a* of the plate 3. For example, when the sepia pattern is to be printed, the recesses 3*a* constitute the pattern 1B (FIG. 2) representing the profile. The projections 5*a* cover the area surrounded by the alternate long and short dashed line of FIG. 2. The nonimage portion excluding the projections 5*a* is engraved to be flat and is not brought into contact with the surface of the plate 3 and a duct roller 6.

With this arrangement, ink 8 stored in an ink duct 7 in the inking unit 4 flows out from a space between the outer surface of the duct roller 6 and the distal end of an ink blade 9 upon rotation of the duct roller 6. The ink 8 (i.e., an ink film 8A) is then applied to the outer surface of the duct roller 6. Upon rotation of the respective duct rollers 6 (the duct roller 6 for the sepia ink in this case), the ink film 8A is transferred as an ink film 8B to the projections 5*a* of the pattern roller 5 and is filled in the recesses 3*a* of the plate 3. Since the size of the projections 5*a* is larger than that of the recesses 3*a*, the ink film 8B is transferred to part of the nonimage portion around the recesses 3*a*. However, the excess ink is wiped by a wiping roller 10 rotating in the same direction as that of the plate cylinder 2 before the recesses 3*a* oppose an impression cylinder. Therefore, only the ink filled in the recess 3*a* is transferred to the sheet. Reference numeral 11 denotes a vibrating roller for spreading the ink film 8A axially of the duct roller into a uniform thickness. Inks for colors excluding sepia can be supplied in the same manner as described above.

A plurality of adjusting screws 12 are aligned in line along the longitudinal direction of the ink duct 7 in the same manner as in a lithographic press. By moving the adjusting screws 12 back and forth, the ink blade 9 is elastically deformed to adjust ink outflow spaces between the duct roller 6 and the ink blade 9 in units of sections along the direction of width of the ink blade. As a result, the amount of ink required for the respective recesses 3*a* in the plate 3, that is, the amount of ink properly filled in the respective recesses 3*a* can be adjusted.

In conventional ink quantity adjustment by the adjusting screws 12, the ink blade 9 cannot precisely respond upon back-and-forth movement of the adjusting screws 12, thus resulting in coarse adjustment. In this case, an amount of ink smaller than a total amount of ink to be filled in the recesses 3*a* is supplied, thereby causing some of the recesses 3*a* to be insufficiently supplied with ink and resulting in a frequent occurrence of a printing error called blinding. In order to prevent blinding, excess ink is supplied to the recesses 3*a* in accordance with the proper amount of ink required for the deepest recesses. The excess ink is removed by the wiping roller 10. The removed ink cannot be reused and is disposed of, thus wasting the ink. Together with this disadvantage, the performance of the wiping unit is degraded and its service life is shortened. In the state-of-the-art printing techniques, the adjusting screws can be adjusted along only the direction of width of the ink film 8*a*. Under these circumstances, the projections 5*a* of the pattern roller 5 must be increased in size by a sufficient margin, thereby further increasing ink consumption.

SUMMARY OF THE INVENTION

It is, therefore, a principal object of the present invention to provide an intaglio printing machine for properly supplying ink to a plate surface.

It is another object of the present invention to provide an intaglio printing machine wherein ink consumption can be decreased and wiping performance can be improved.

In order to achieve the above objects of the present invention, there is provided an intaglio printing machine which includes a plate cylinder having a plate thereon, a pattern roller having projections which are in rolling contact with an outer surface of the plate, and an inking unit with a duct roller which is in rolling contact with the pattern roller, wherein the duct roller has substantially the same diameter as a diameter of the pattern roller which includes the projections, and ink holding recesses having different depths corresponding to those of the plate are formed in an outer surface of the duct roller along circumferential and axial directions thereof.

DESCRIPTION OF THE PREFERRED EMBODIMENT

The present invention will be described in detail with reference to the accompanying drawings.

Figure 3:
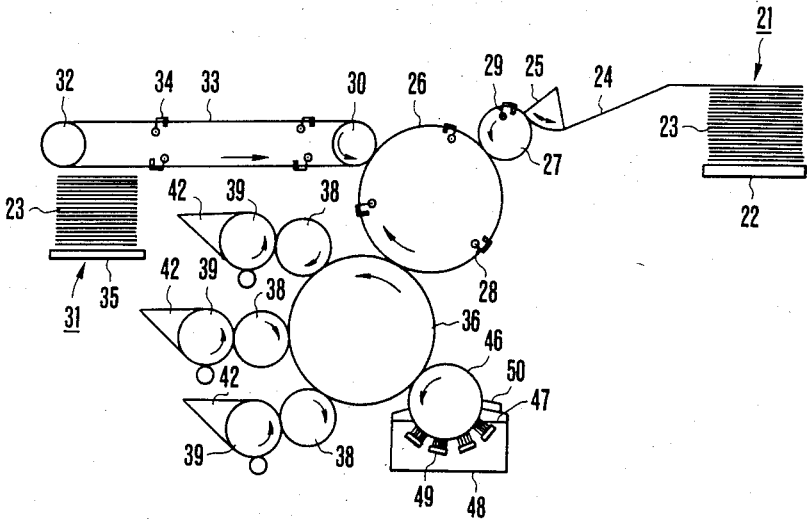
FIG. 3 is a side sectional view showing the overall configuration of an intaglio printing machine according to an embodiment of the present invention.
Figure 4:
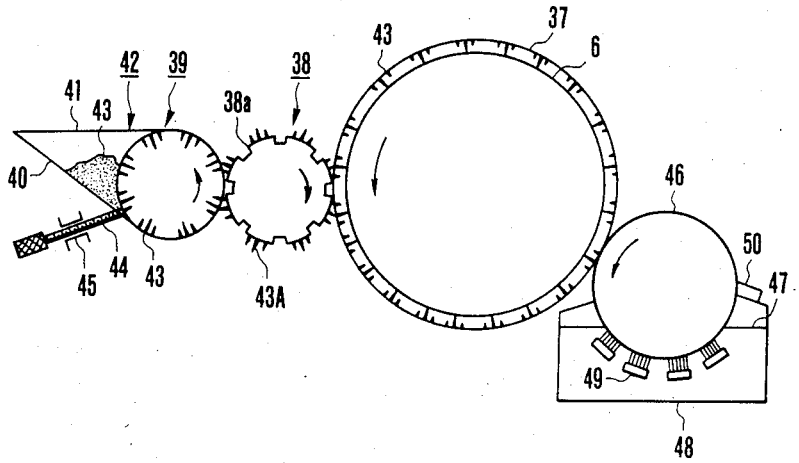
FIG. 4 is a side sectional view showing the main part of the intaglio printing machine of FIG. 3 so as to explain principles of ink supply and wiping.
Figure 5:
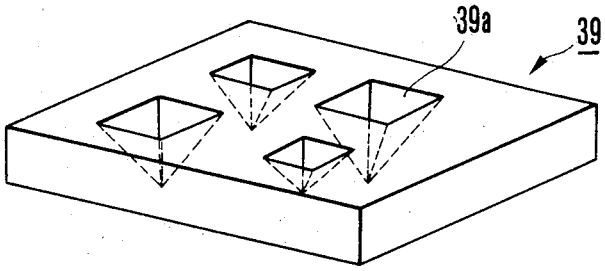
FIG. 5 is a perspective view of an outer surface of a duct roller in the intaglio printing machine of FIG. 3.
Figure 6:
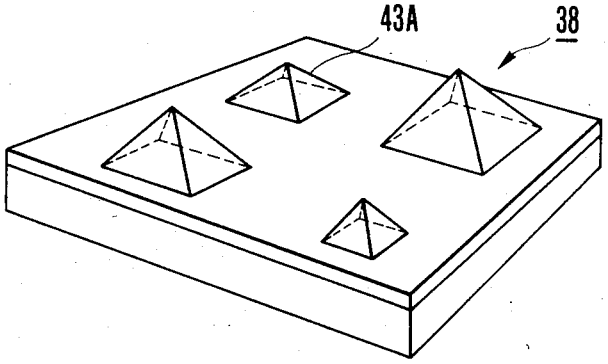
FIG. 6 is a perspective view of an ink film transferred to an outer surface of a pattern roller in the intaglio printing machine of FIG. 3.

FIGS. 3 to 6 show an intaglio printing machine according to an embodiment of the present invention, in which FIG. 3 is a side sectional view showing the overall configuration thereof, FIG. 4 is a side sectional view showing the main part thereof so as to explain the principles of ink supply and wiping, FIG. 5 is a perspective view showing the outer surface of a duct roller thereof, and FIG. 6 is a perspective view of an ink film transferred to an outer surface of a pattern roller.

Referring to FIGS. 3 to 6, sheets 23 for printing banknotes are stacked on a sheet table 22 in an automatic feeder 21. Banknotes are printed on the sheets 23. The sheets 23 are fed by a sucker unit (not shown) one by one, so that each sheet 23 is fed onto a feedboard 24. Reference numeral 25 denotes a swing gripper unit which is swung by a cam mechanism. The swing gripper unit 25 has a plurality of grippers aligned in line along the axial direction thereof, so that the grippers grip each sheet 23 and swing to feed it. Reference numeral 26 denotes an impression cylinder having a diameter which is three times that of a regular impression cylinder. A transfer cylinder 27 has a $\frac{1}{3}$ diameter of the impression cylinder 26 and is in rolling contact therewith. The grippers of the swing gripper unit 25 oppose the outer surface of the transfer cylinder 27. Three gripper rows, each having a plurality of grippers 28, are arranged at locations equally dividing the outer surface of the impression cylinder 26 along the circumferential direction, respectively. A row of a plurality of grippers 29 is arranged at a location of the outer surface of the transfer cylinder 27. The row of the grippers 29 is aligned with each of the rows of grippers 28 upon rotation of the impression and transfer cylinders 26 and 27. The sheet 23 gripped by the swing gripper unit 25 is sequentially transferred in an order of the grippers 29 and 28 and is wound around the outer surface of the impression cylinder 26. A pair of right and left sprockets 30 are mounted coaxially with a delivery cylinder which is located at a position opposite to the transfer cylinder 27, and which faces the outer surface of the impression cylinder 26. A pair of right and left delivery chains 33 are looped between the sprockets 30 and a pair of sprockets 32 arranged in a delivery unit 31. Each of gripper rods bridging the right and left delivery chains 33 at equal intervals has a plurality of delivery grippers 34. The sheet 23 printed between the impression cylinder 26 and a plate cylinder (to be described later) is transferred from the grippers 28 of the impression cylinder 26 to the delivery grippers 34. A delivery table 35 is disposed below the feed end of the delivery chains 33 to receive the sheet 23 conveyed and released from the delivery grippers 34.

Reference numeral 36 denotes a plate cylinder having a diameter which is three times that of a regular impression cylinder as in the case of the impression cylinder 26. Three plates 37 are mounted on the outer surface of the plate cylinder at equal angular intervals. Each plate 37 has 32 recesses of an image matrix of 8 rows $\times 4$ columns each representing a pattern of the banknote as an object to be printed. The recesses comprise shallow and deep recesses in accordance with the pattern of the banknote. In particular, when banknotes are printed, depths of recesses fall within the range of 40 to 180$\mu$. A line pressure of about 1,200 kg/cm, i.e., a surface pressure of about 4.1 kg/mm$^2$ is generated by pressure contact between the surface of the plate 37 and the outer surface of the impression cylinder 26.

Figure 1:
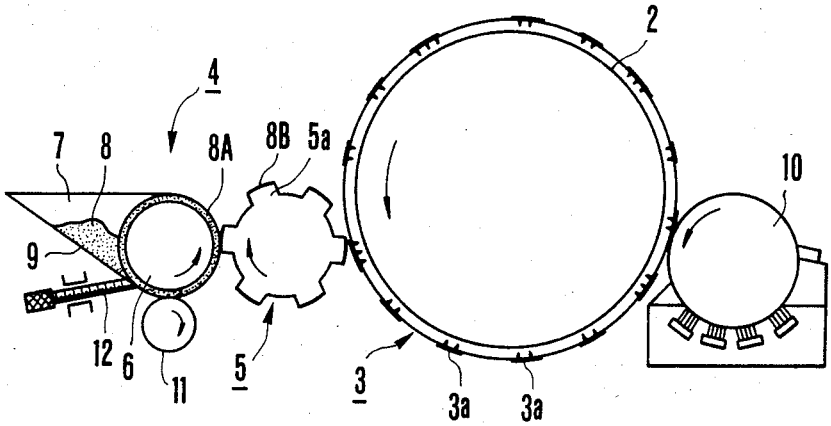
FIG. 1 is a side sectional view showing the main part of a conventional intaglio printing machine so as to explain a principle of ink supply.
Figure 2:
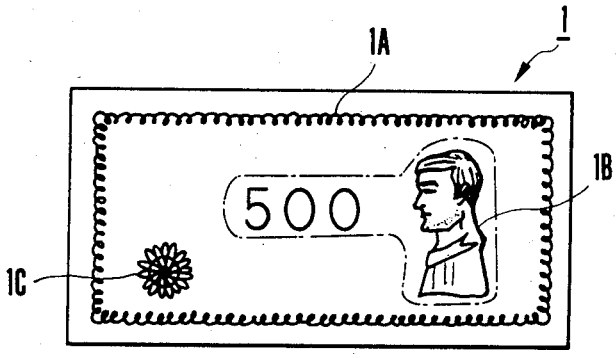
FIG. 2 is a plan view of a banknote as an example of printed matter.

Three pattern rollers 38 each with a diameter about $\frac{1}{3}$ that of the plate cylinder 36 are in rolling contact with the surfaces of the plates 37 on the plate cylinder 36. Each pattern roller 38 has 8 projections 38*a* corresponding to the number of rows of the banknote so as to print a corresponding color pattern. The projections 38*a* are larger than the recesses of the plates 37, respectively. For example, when the sepia pattern is to be printed, the recesses constitute the pattern 1B (FIG. 2) for the profile. The projections 38*a* have a size corresponding to the area surrounded by the alternate long and short dashed line of FIG. 2. A nonimage portion excluding the projections 38*a* is cut away and is not brought into contact with the plates 37.

A duct roller 39 having substantially the same circumferential length as a total length of the projections 38*a* is in rolling contact with the outer surface of each pattern roller 38. Each ink duct 42 is defined by an ink blade 40 inclined such that its distal end is in contact with the outer surface of the duct roller 39, triangular ink dams 41 for closing the openings at opposite sides of the ink blade 40, and the pattern roller 38. Three different inks 43 are stored in the corresponding ink ducts 42, respectively. A plurality of adjusting screws 44 (only one adjusting screw is illustrated) are provided for adjusting distortion of the ink blade 40. The adjusting screws are aligned in line along the roller shaft such that each adjusting screw is threadably engaged with a partially illustrated ink duct 45 and moves back and forth with respect thereto.

In the intaglio printing machine of this embodiment, ink holding recesses 39*a* are formed in the outer surface of the duct roller 39 to be aligned with the projections 38*a* in the pattern roller along the axial and circumferential directions. The formation of the recesses 39*a* will be described hereinafter. A proof sample of banknote size printed by an intaglio printing machine or a large proof sample is photographed to prepare a block copy such that light, intermediate and dark portions are hand-touched with India ink in accordance with depths and densities of the recesses, i.e., with the amounts of ink required for the plate 37, thereby obtaining gradation. The block copy or a proofed halftone block is set on a copy set drum of an electronic photoengraving machine. The duct roller 39 is set in a gravure cylinder unit. The number of actual images, a distance between the images, a proper magnification factor of about 0.2 to 2% along the circumferential direction, and a proper number of screen lines (40 to 70 lines/inch) are manually entered with a numeric keypad. The plate material is automatically directly engraved from the copy without using the film. As shown in an enlarged perspective view of FIG. 5, the ink holding recesses 39*a* are formed in correspondence with the image portion of the plate 37. A deep recess 39*a* is formed for a thick line requiring a larger amount of ink and a shallow recess 39*a* is formed for a thin line called a hair line. A halftone portion is read by a scanning head in accordance with a contrast of the copy, and the read data is analyzed by a computer in a control board. The size of the recess 39*a* is instantaneously determined to continuously form recesses 39*a* having different depths corresponding to the different contrast levels. The surface of the resultant duct roller 39 reflects various conditions (e.g., a difference between image and nonimage portions, gradation in the image portion, and layout precision) of the plate 37 and has a surface precisely corresponding to the plate 37. In this manner, the outer surface of the duct roller 39 represents full information and printing conditions. FIG. 6 is an enlarged perspective view showing the outer surface of the pattern roller 38. Reference numerals 43A denote ink portions transferred from the recesses 39*a* in the duct roller 39 to the projections 38*a* in the pattern roller 38.

A wiping roller 46 is disposed obliquely below the plate cylinder 36 and rotates in the same direction as that of the plate cylinder 36 such that the surfaces thereof are in rolling contact and move opposite to each other. A wiping tank 48 for storing a cleaning liquid 47 is disposed under the wiping roller 46. A plurality of brushes 49 are dipped in the cleaning liquid 47 together with the wiping roller 46. The excess ink removed by the wiping roller 46 from the surface of the plate 37 is washed in the cleaning liquid 47. A doctor blade 50 is in tight contact with the surface of the wiping roller 46 so as to remove the cleaning liquid therefrom.

The operation of the intaglio printing machine having the structure described above will be exemplified in the case of banknote printing. The sheets 23 placed on the sheet table 22 of the automatic feeder 21 are fed by the sucker unit one by one. Each sheet 23 is thus fed onto the feedboard 24. The sheet 23 is gripped by the grippers of the swing gripper unit 25 and fed by swinging motion. The sheet 23 is then transferred to the grippers 28 in the impression cylinder 26 through the grippers 29 in the transfer cylinder 27. The transferred sheet 23 is wound around the impression cylinder 26 upon its rotation and passes between the impression cylinder 26 and the plate cylinder 36 under a high pressure. The ink 43 stored in the ink duct 42 flows out from a space between the outer surface of the duct roller 39 and the ink blade 40 upon rotation of the duct roller 39. The ink is held in the recesses 39*a* in the duct roller 39. The held ink 43 is transferred to the corresponding projections 38*a* in the pattern roller 38 upon rotation of the rollers 38 and 39. As indicated by reference numeral 43A of FIG. 6, the ink pattern having different gradation levels corresponding to the image portion of the plate 37 is formed.

Figure 7:
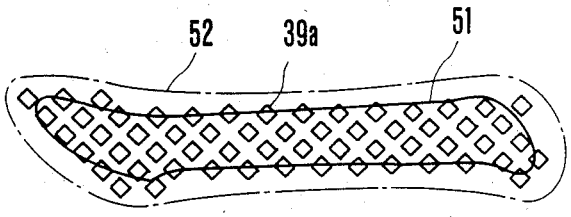
FIG. 7 is a representation for explaining the relationship between ink holding recesses of the duct roller, the projections of the pattern roller and the image portion of the plate.

FIG. 7 is a representation for explaining the relationship between the recesses 39*a* and the image portion of the plate when a kanji character "-" which stands for "one" is exemplified. A solid line 51 represents the image portion of the plate. The recesses 39*a* in the duct roller 39 cover a wider area than the solid line 51 and have substantially the same depths as those of the recesses of the plate. An alternate long and short dashed line 52 represents a pattern on the outer surface of the pattern roller 38. The ink pattern 43A transferred onto the projections 38*a* of the pattern roller 38 is filled in the image portion of the plate 37. Excess ink is attached to a portion around the image portion, as indicated by the alternate long and short dashed line 52 in FIG. 7. The excess ink is removed by the wiping roller 46 which is rotated and slipped against the outer surface of the plate cylinder 36. Only the ink in the recesses is left when the plate 37 passes the wiping roller 46. The ink is then transferred to the sheet 23 passing between the impression cylinder 26 and the plate cylinder 36 under a high pressure, thereby performing intaglio printing. The resultant sheet 23 is transferred from the grippers 28 in the impression cylinder 26 to the delivery grippers 34. The sheet 23 is fed together with movement of the delivery chains 33 and released and dropped at the feed end. The dropped sheet 23 is stacked on the delivery table 35. In the intaglio printing machine according to this embodiment, the amount of ink need not be adjusted by the ink blade 40 in units of sections thereof. Unlike the conventional ink blade, the blade 40 has higher mechanical rigidity. The adjusting screws 44 do not adjust the amount of ink but the distortion of the ink blade 40 only, thereby decreasing the required number to less than half.

In intaglio printing described above, a position adjusting mechanism included in the machine is used to position the duct roller 39 with respect to the plate cylinder 36 along the circumferential and axial directions thereof. In addition, when printing is performed after the space between the ink blade 40 and the duct roller 39 is adjusted to fall within a tolerance of 0.03 to 0.05 m/m, the adjusting screws 44 need not be adjusted to supply the proper amount of ink to the image portion of the plate 37. Moreover, the amount of ink removed by the wiping roller can be greatly decreased.

As is apparent from the above description, in the intaglio printing machine according to the present invention, the outer diameter of the duct roller is set to be substantially the same as that of the larger diameter of the pattern roller, and ink holding recesses having the same depths as those of the plate are formed along circumferential and axial directions thereof. The accurate amount of ink required by each recess of the plate can be supplied, and excess ink which must be disposed of can be greatly decreased, thereby decreasing ink consumption. At the same time, the wiping roller can be underloaded, and wear thereof can also be decreased to result in improvement of durability. Furthermore, contamination of the cleaning liquid can be decreased to extend its replenishment cycle. In addition, the conventional adjusting screws for adjusting the amount of ink can be omitted. As a result, an unskilled operator can perform intaglio printing of high quality, and labor can be decreased while at the same time product quality can be improved.

What is claimed is:

1. An intaglio printing machine including a plate cylinder having plate means thereon, said plate means having ink holding recesses of different depths, a pattern roller having projections which are in rolling contact with an outer surface of said plate means, and an inking unit with a duct roller which is in rolling contact with said pattern roller, wherein said duct roller has substantially the same diameter as a diameter of said pattern roller which includes said projections, and ink holding recesses having different depths corresponding to those of said plate means are formed in an outer surface of said duct roller along circumferential and axial directions thereof.

2. A machine according to claim 1, wherein said ink holding recesses also serve as ink amount adjusting recesses.

3. A machine according to claim 2, wherein said inking unit further includes an ink blade of high rigidity and distortion adjusting screws for adjusting distortion of said ink blade.

4. A machine according to claim 3, wherein said duct roller is aligned with said plate cylinder along circumferential and axial directions thereof to set a space between said ink blade and said duct roller to be 0.03 to 0.05 millimeter along a longitudinal direction of said ink blade.

5. A machine according to claim 4, wherein said plate cylinder has a diameter which is three times that of said duct roller, and said plate means comprises three plates so as to perform three-color printing.

* * * * *